United States Patent [19]

Buckett

[11] Patent Number: 4,925,094

[45] Date of Patent: May 15, 1990

[54] CONCRETE RAILROAD TIES

[75] Inventor: John Buckett, Kings Langley, England

[73] Assignee: Costain Concrete Company Limited, Hoddesdon, England

[21] Appl. No.: 227,405

[22] Filed: Aug. 2, 1988

[30] Foreign Application Priority Data

Aug. 6, 1987 [GB] United Kingdom ..... 8718665

[51] Int. Cl.[5] ..... E01B 9/68

[52] U.S. Cl. ..... 238/265; 238/270; 238/271; 238/283; 238/298; 238/304

[58] Field of Search ..... 238/264, 270, 271, 287, 238/297, 298, 88, 99, 101, 102, 103, 112, 148, 265, 283, 298, 304

[56] References Cited

U.S. PATENT DOCUMENTS

| | | | |
|---|---|---|---|
| 801,278 | 10/1905 | Terwilleger | 238/265 |
| 1,045,741 | 11/1912 | Pinney | 238/265 X |
| 1,058,435 | 4/1913 | Hyle | 238/304 X |
| 3,062,450 | 11/1962 | Hanff | 238/287 |
| 3,129,887 | 4/1964 | Meier | 238/265 |
| 3,826,424 | 7/1974 | McClung et al. | 238/264 |
| 3,904,112 | 9/1975 | Thim et al. | 238/265 X |
| 4,494,695 | 1/1985 | Sonneville | 238/265 |

FOREIGN PATENT DOCUMENTS

| | | | |
|---|---|---|---|
| 1435116 | 5/1976 | United Kingdom | 238/264 |

*Primary Examiner*—Andres Kashnikow

*Attorney, Agent, or Firm*—Biebel, French & Nauman

[57] ABSTRACT

A concrete railroad tie has rail seats defined by plates, which are made from stainless steel or other non-corrodable metal or plastic, cast into the top surface of the tie at the rail seats. The stiffness of the plates should be less than that of the concrete body of the tie and they should have smooth top faces so that they do not cause scuffing of associated rail pads on which the rails rest at the seats. Each plate may have lugs projecting from its underside for providing a mechanical connection with the body of the tie.

3 Claims, 1 Drawing Sheet

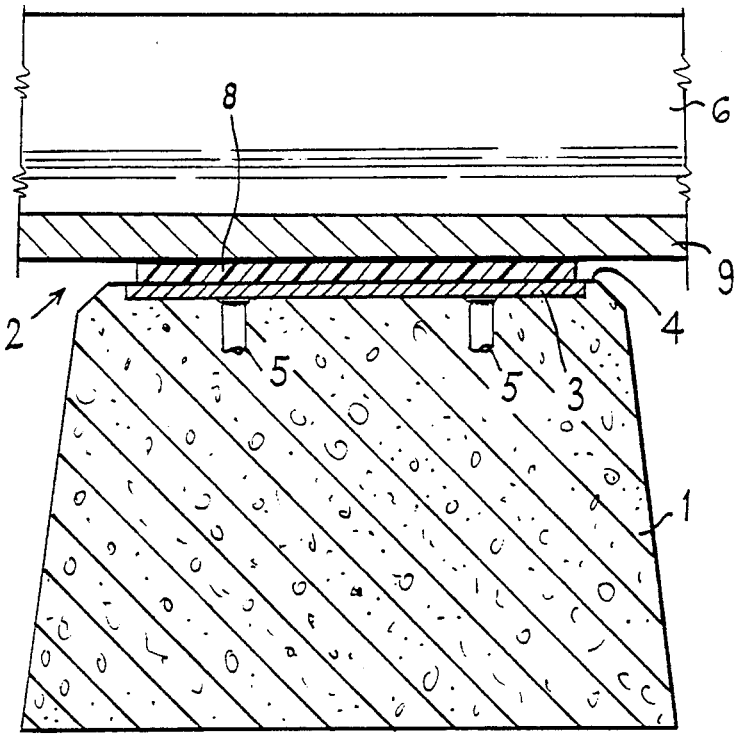
Fig.1
Fig.2
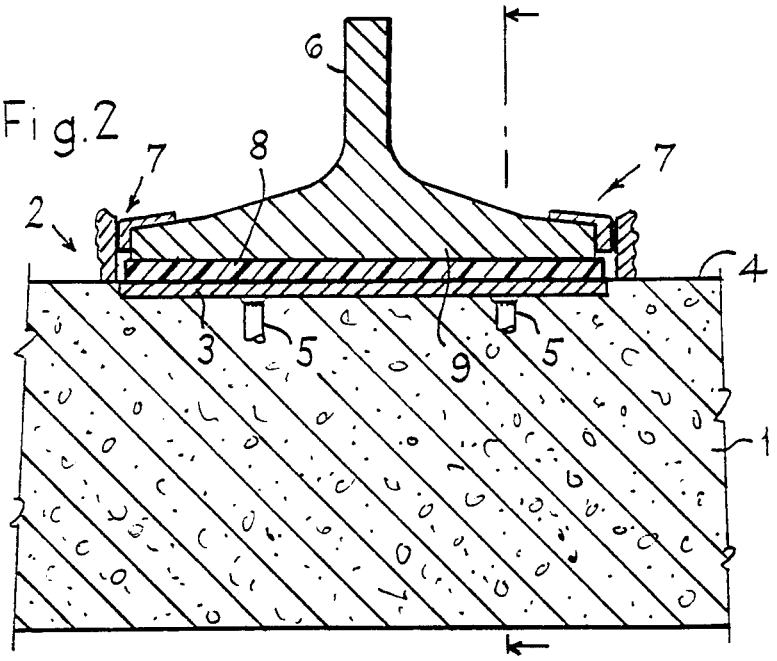

CONCRETE RAILROAD TIES

BACKGROUND OF THE INVENTION

The present invention relates to concrete railroad cross ties or sleepers and, more particularly, to railroad ties having rail seats provided with improved abrasion resistance.

Since the early 1960's concrete cross ties have generally been used with direct fixings in which the rail rests on a rubber or plastic pad which in turn rests on the moulded concrete top surface of the tie.

If the pad, which is known as a rail or tie pad is omitted or moves out of position it is well known that direct contact of the rail on the tie can result in serious abrasion of the concrete surface. In such a case, the concrete is ground away by the rail leaving a smooth surface and, if the reduction in depth of the concrete does not lead to structural failure, the tie can continue in service provided the original depth of the sleeper is restored with additional rail pads.

A different type of abrasion has been encountered where the surface of the concrete under the rail pad is eroded. The appearance is that the coarse aggregate is largely unaffected but the mortar (sand and cement) fraction is eroded to a depth of several millimetres leaving a rough surface.

This type of abrasion can occur in a period of two years which is very short in relation to the nominal 40–50 year life of a concrete tie. Apart from ultimately affecting the structural strength of the tie, an immediate problem is that the rough surface causes unacceptably rapid wear of the rail pads. This is serious because one function of the rail pad is to provide electrical insulation between the rail and the tie so that track circuiting can be used as part of the signalling system. So far this form of abrasion has only been found in a location where there is a small radius curve in the track, the trains are heavy, the gross tonnage is high and the climate is wet except in winter when temperatures are generally below freezing. However, it is of sufficient importance to have an adverse effect on the market for concrete ties.

Research has been directed at improving the abrasion resistance of the surfaces of the concrete ties immediately under rails. Techniques exist for producing abrasion resistant surfaces on concrete floors but these depend upon work hardening techniques within a few hours of casting the concrete. This method cannot be used on concrete ties because they are cast upside down so that the top surface is in contact with an accurately made steel mould to ensure the tight tolerances on rail seat flatness and other features are satisfied. Another technique is to improve the curing of concrete by preventing premature drying out of the water required to hydrate the cement. This method has shown some improvement in abrasion resistance but not sufficient to ensure satisfactory performance in the most arduous conditions in track.

A surface coating, such as epoxy resin, is used in coal hoppers and other places where abrasion of concrete occurs. This is costly and because of the high loadings and high frequency stress reversals in track there is concern that the coating might become detached from the concrete. If this occurred it would not be practicable to renew the coating.

The composition of the concrete has an effect on abrasion resistance and the use of harder fine aggregate, such as silicon carbide, should improve the resistance to erosion. However, it is impracticable to cast a part of a tie from different concrete during the normal production process and ensure that it remains in the intended part of the tie. To use special concrete throughout would be prohibitive in material cost and, also, capital cost for additional equipment to store and measure the special materials.

It would be possible to cast a cross tie with a recess in the rail seat and fill it at a later stage with a special concrete. As with a surface coating this introduces a risk that the special concrete will, under the influence of high loads, dynamic action and frost action, become separated from the main body of the tie. Additionally there is a high cost in rehandling the tie and filling the recess with special concrete.

SUMMARY OF THE INVENTION

An object of the present invention is to provide a railroad cross tie with means which improves the abrasion resistance of the tie at the rail seats and which avoids the high cost and other disadvantages of hitherto proposed methods of improving abrasion resistance.

With a view to achieving this objective, the present invention provides a concrete railroad tie in which each rail seat has a stainless steel or other non-corrodable metal or plastics plate secured to the top surface of the tie.

It is important that each rail seat plate be made of a non-corrodable material and, also, that its stiffness be less than the concrete body of the tie. This is to ensure that the plate does not separate from the concrete owing to a build-up of corrosion products between the plate and the concrete or to differential deflection under load.

Conveniently, each rail seat plate is cast into the tie during moulding thereof. It may have means, such as lugs, projecting from its underside and cast into the concrete tie to provide a mechanical connection with the body of the tie. Preferably, the upper surface of each plate is substantially flush with the surrounding top surface of the tie. The surface of each plate should be smooth so that the scuffing of an associated rail pad does not occur.

An advantage of the invention is that it involves the minimum extra work during production of a cross tie as it is only necessary to locate each rail seat plate in the mould before filling with concrete. Anti-abrasion treatments which involve work on a tie after manufacture are costly in term of labour.

BRIEF DESCRIPTION OF THE DRAWINGS

In order that the present invention may be more readily understood, reference will now be made to the accompanying drawings, in which:

FIG. 1 is a cross sectional view through one rail seat of a concrete railroad tie embodying the invention and showing a rail supported on the rail seat, and FIG. 2 is a longitudinal section through the rail seat of FIG. 1.

DETAILED DESCRIPTION OF THE PREFERRED EMBODIMENT

Referring to the drawings, the concrete railroad tie 1 has two suitably spaced rail seats 2 on its top surface (one being illustrated), each of which comprises a rectangular stainless steel plate 3, for example, 3mm thick, cast into the top surface 4 of the tie so that the top surface of the plate is flush with the surrounding surface 4 of the tie. In order to cast the plates 3 into the tie, they are simply located in the tie mould before filling with concrete. Each plate 3 has lugs 5 projecting downwardly from its underside which provide a mechanical connection with the concrete body of the tie.

Each stainless steel plate 3 is non-corrodable and its stiffness is small relatively to the concrete body of the tie so that, in use, the plate will not separate from the concrete owing to a build-up of corrosion products between the plate and the concrete or differential deflection under load. Each plate also has a smooth upper surface which ensures that scuffing of a rail pad does not occur.

A rail 6 is fastened to the tie 1 in a position to rest on a rail seat 2 by conventional fastening components 7, with a plastics rail pad 8 disposed between the underside of the rail flange 9 and the stainless steel rail seat plate 3. The latter provides the necessary abrasion resistance to avoid the problem described above.

Whilst a particular embodiment has been described, it will be understood that modifications can be made without departing from the spirit and scope of the invention, as defined by the annexed claims.

I claim:

1. In an assembly comprising a concrete railroad tie, at least one rail seat situated on a top surface of said tie, at least one railroad rail having a rail flange, and means securing said rail to said tie with said rail flange supported on said rail seat, the improvement which enhances abrasion resistance of said tie at said rail seat and which is characterised by:

a rectangular plate made from non-corrodible material and defining said rail seat, said corrodible material being selected from the group comprising stainless steel, other non-corrodible metal and plastic, said plate being of substantially the same width as said rail flange and extending substantially across the full width of said tie beneath said rail flange, said plate having a stiffness less than that of said concrete tie and a smooth upper surface, and a tie pad located between said rail and said plate and having said rail flange resting thereon, said tie pad being made from a material selected from the group comprising rubber, plastic and the like.

2. The improvement claimed in claim 1, wherein said plate is cast into said concrete tie and has an upper face located substantially flush with said top surface of said tie.

3. The improvement claimed in claim 1, wherein said plate has lug means projecting downwardly from the under face thereof and cast into said tie to provide a mechanical connection with said tie.

* * * * *